US010504495B1

(12) United States Patent
Pawlovich

(10) Patent No.: US 10,504,495 B1
(45) Date of Patent: Dec. 10, 2019

(54) KICK DRUM PEDAL CLAMP MECHANISM

(71) Applicant: Daniel Pawlovich, Costa Mesa, CA (US)

(72) Inventor: Daniel Pawlovich, Costa Mesa, CA (US)

( * ) Notice: Subject to any disclaimer, the term of this patent is extended or adjusted under 35 U.S.C. 154(b) by 0 days.

(21) Appl. No.: 16/029,044

(22) Filed: Jul. 6, 2018

(51) Int. Cl.
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS

| | | | |
|---|---|---|---|
| 2,672,784 | A | 3/1954 | Sabo |
| 3,347,542 | A | 10/1967 | Mericle, Jr. |
| 3,677,128 | A | 7/1972 | Simpson |
| 4,134,325 | A | 1/1979 | Loftus |
| 4,691,613 | A | 9/1987 | Jacobson |
| 4,965,914 | A | 10/1990 | Confer et al. |
| 5,714,701 | A | 2/1998 | Hsieh |
| 5,994,634 | A | 11/1999 | Cady |
| 6,595,507 | B2 | 7/2003 | Dykstra |
| 6,632,990 | B2 | 10/2003 | Menzel et al. |
| 6,649,820 | B2 | 11/2003 | Sassmannshausen |
| 6,862,961 | B2 | 3/2005 | Winkler |
| 6,924,422 | B2 | 8/2005 | Wise |
| 6,932,335 | B1 | 8/2005 | Dykstra |
| 7,381,877 | B2 | 6/2008 | Shigenaga |
| 8,026,434 | B2 | 9/2011 | Luo |
| 8,177,445 | B2 | 5/2012 | Jones et al. |
| 8,178,769 | B2 | 5/2012 | Steele |
| 8,389,848 | B1 | 3/2013 | Baker |
| 8,674,203 | B2 | 3/2014 | Simon |
| 9,027,447 | B2 | 5/2015 | Cripps |
| 9,053,687 | B1 | 6/2015 | Benson |
| 9,685,146 | B2 | 6/2017 | Shigenaga et al. |
| 9,721,548 | B1 | 8/2017 | Krause |
| 2002/0194980 | A1 | 12/2002 | Hsieh |
| 2006/0156901 | A1 | 7/2006 | Dorfman et al. |

(Continued)

OTHER PUBLICATIONS

"Pro1-V BigFoot Chain Single—Trick Drums" Trick Drums USA, obtained Jun. 24, 2019 from <https://www.trickdrums.com/p1vbf1c.html>, 3 pages.

(Continued)

*Primary Examiner* — Kimberly R Lockett
(74) *Attorney, Agent, or Firm* — Dorsey & Whitney LLP

(57) ABSTRACT

A drum pedal apparatus includes a base or base plate, a footboard pivotably coupled to the base plate, the footboard operable to drive a mallet to strike a drum, and a clamping mechanism attached to the base plate adjacent the footboard. The clamping mechanism includes a first lever arm adapted to couple the drum pedal apparatus to a drum hoop of a drum, a pivot assembly coupled to the first lever arm, and a second lever arm coupled to the first lever arm via the pivot assembly. The second lever arm can be adapted to operate the clamping mechanism, where the clamping mechanism applies a selected clamping force to the drum hoop responsive to the second lever arm pivoting relative to the first lever arm at the pivot assembly.

20 Claims, 6 Drawing Sheets

(56) References Cited

U.S. PATENT DOCUMENTS

| | | | | |
|---|---|---|---|---|
| 2006/0278060 | A1* | 12/2006 | Shigenaga | G10D 13/006 84/422.1 |
| 2013/0187322 | A1 | 7/2013 | Woods | |
| 2014/0182445 | A1 | 7/2014 | Liao | |
| 2015/0246432 | A1 | 9/2015 | Craig et al. | |

OTHER PUBLICATIONS

International Search Authority, International Search Report and Written Opinion for PCT/US2019/040093, "Foreign Counterpart to U.S. Appl. No. 16/029,044" dated Sep. 20, 2019, pp. 1-73, Published in: WO.

* cited by examiner

KICK DRUM PEDAL CLAMP MECHANISM

FIELD

The technology described here relates generally to drum systems, including kick drum pedal assemblies for a drum apparatus. Applications include high performance pedal assemblies with advanced hoop clamp mechanisms, adapted for improved operational stability and performance.

BACKGROUND

Modern drummers typically perform on a set of snare, tom, tenor, and bass drum (or kick drum) instruments, with a combination of crash, ride, and high-hat cymbals and other accessories. Drum sets are adapted for the drummer to use both hands and feet, in order to play all of the different components of the drum set, during a given performance.

A common type of drum played by foot is the kick drum or bass drum. Bass drums are often the largest drum in the set; however, the bass drum itself can vary in size. Suitable bass drums are usually adapted to produce a range of lower-pitched notes and sounds, and are used in numerous musical genres.

To play a kick drum or bass drum by foot, drummers generally use a kick drum pedal. Kick drum pedal technologies emerged by the late 1800s. The first designs were generally made of wood, and incorporated a pendulum-type beater hanging from the top of the bass drum hoop or rim, connected to the foot pedal by a cord or rod. Over time, kick drum pedal designs were improved in a variety of forms, including current versions that typically rest on the floor, along with the drum, and mount to the drum along the bottom section of the rim.

Contemporary kick drum pedal designs typically include, among other elements, a base plate, a heel plate, a footboard, a chain, a beater shaft, a beater mallet, a spring, and a hoop clamp. The drum pedal is positioned next to the bass drum, so that the beater mallet strikes the drum generally parallel to the drum head. The pedal usually attaches to the kick drum hoop, which is a ring of wood or metal that holds the drum head onto the drum shell or drum body. In principle, the attachment prevents the kick drum pedal from moving while a drummer plays the drum, but not all drum pedal technologies work equally well, particularly in high-performance settings where the pedal is subject to continuous operational stress. A range of different hoop configurations must also be accommodated, with different attachment geometries.

One approach to attaching the kick drum pedal to the drum hoop is via a traditional hoop clamp. The drum rim slides in between the pedal base plate and hoop clamp, so that the clamp can be screwed down or otherwise tightened onto the drum hoop or rim, while holding the drum in place. Traditional hoop clamps can be manually engaged and tightened by turning a drum key or a screw located either on the side of the pedal or on the back end of the hoop clamp.

Hoop clamp adjustments can be hard to reach when installed in a drum set, making pedal setup and adjustment difficult. When the clamp adjustment is on the back, for example, the drummer may need to reach around the footboard to manually turn the screw. When the clamp adjustment is on the side of the pedal, the drummer may need to work around any number of other drums, cymbal stands and other components, just to reach the clamp, and the adjustment mechanism can be difficult to operate in this position.

Because the clamp mechanism requires precise manual adjustment, it can be difficult to maintain a suitable coupling to the drum hoop. The drummer has to tighten the clamp sufficiently so that the pedal does not come loose while playing, while being sure to not overtighten the mechanism, which can lead to failure. As a result, existing clamp designs do not always maintain an effective grip on the drum hoop, and can fail during operation, making it difficult or impossible to play the drum. There thus remains a need for improved kick drum pedal designs, with better coupling technologies adapted to properly maintain a grip on the drum hoop, while making the drum setup and pedal installation process easier.

The information included in this background section of the specification, including any references cited herein and any description or discussion thereof, is included for technical reference purposes only. The background is not to be regarded as subject matter by which the scope of invention is limited or bound, as defined by the claims.

SUMMARY

This application is directed to a kick drum pedal assembly for a drum apparatus, including a drum pedal with an improved, lever-actuated hoop clamp mechanism. The kick drum pedal includes one or more of a base plate, a heel plate, a footboard, a chain or belt drive, a beater shaft, a beater mallet, a spring, and a hoop clamp mechanism with a lever actuator. The lever actuator is configured to facilitate coupling of the kick drum pedal to a hoop member of a kick drum or bass drum.

This summary is provided to introduce a selection of concepts in a simplified form that are further described below in the detailed description. The summary is not intended to identify key or essential features of the claimed subject matter, nor is it intended to limit the scope of the claims. A more extensive presentation of features, details, utilities, and advantages of the present invention as defined in the claims is provided in the following written description of various embodiments and implementations, and illustrated in the accompanying drawings.

BRIEF DESCRIPTION OF THE DRAWINGS

Turning now to the drawings, a kick drum pedal and lever-actuated hoop clamp mechanism will be discussed in more detail, according to various embodiments of the present disclosure.

DETAILED DESCRIPTION

This application describes a kick drum pedal with a lever-actuated hoop clamp. Depending on the embodiment, the pedal assembly can include one or more of a base plate, a heel plate, a footboard, a chain or belt drive, a beater shaft, a beater mallet, a spring, and a hoop clamp mechanism with a lever actuator. The hoop clamp mechanism can include one or more of a lever actuator, a pivot arrangement, a front clamp arm or caliper, a pad, a length adjustment, and a release.

Figure 1:
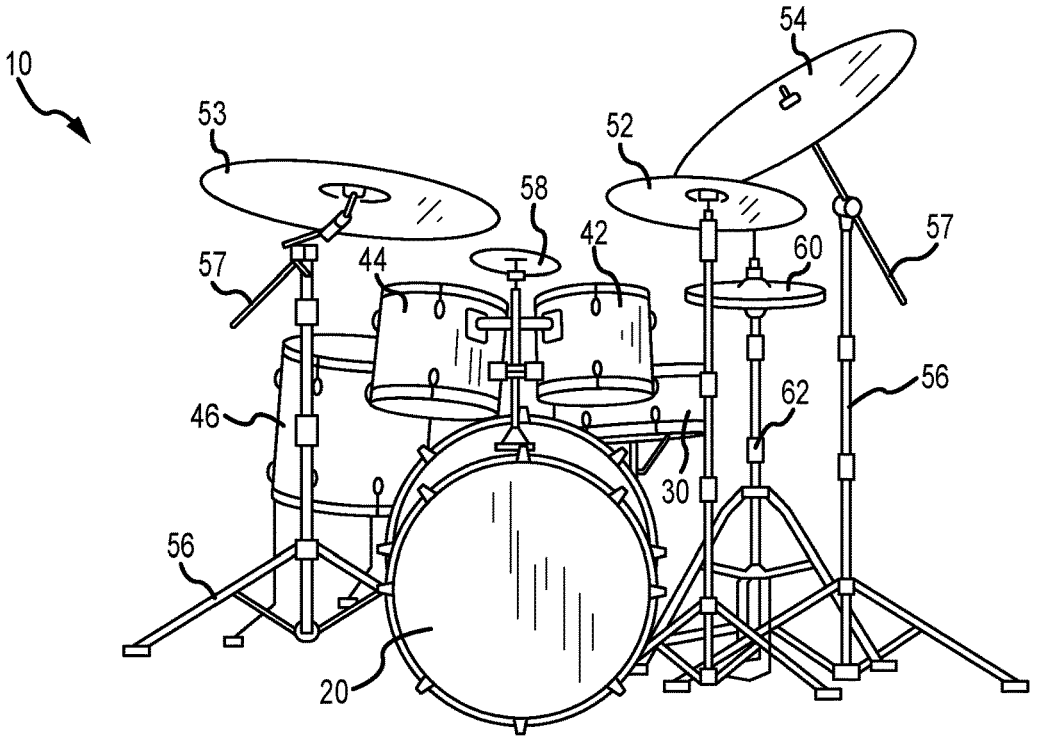
FIG.1 (PRIOR ART)
FIG. 1 is a front view of a drum set apparatus with a kick drum.

FIG. 1 is a front view of a drum set apparatus 10, including at least one kick drum 20. In this particular configuration, drum set 10 also includes a snare drum 30, a small or high tom 42 and middle tom 44 mounted to the kick drum 20, and a larger low (or floor) tom 46. Typical cymbal arrangements include one or more crash cymbals 52 and ride cymbals 53, 54, e.g., mounted to cymbal stands 56 via a boom arm 57, and a "splash" cymbal 58 mounted to kick drum 20, with a high hat 60 on its own hi-hat stand 62.

The number and arrangement of the individual drums 20, 30, 42, 44, 46, cymbals 52, 53, 54, 58 and other accessories 60 in drum set 10 is merely representative, and varies depending on individual drummer preference and playing style. The arrangement of the drum set 10 also depends on the drummer position, performance venue, and available space, which can also differ widely, from large classical performance halls and arena stages to smaller, more intimate settings. Traditionally, the kick drum pedal attachment to the kick drum 20 is done by hand, and, given the space requirements and the number of components in a typical drum set 10, it can be difficult to access the attachment mechanism in order to ensure the proper pedal positioning and attachment to the kick drum 20.

Figure 2:
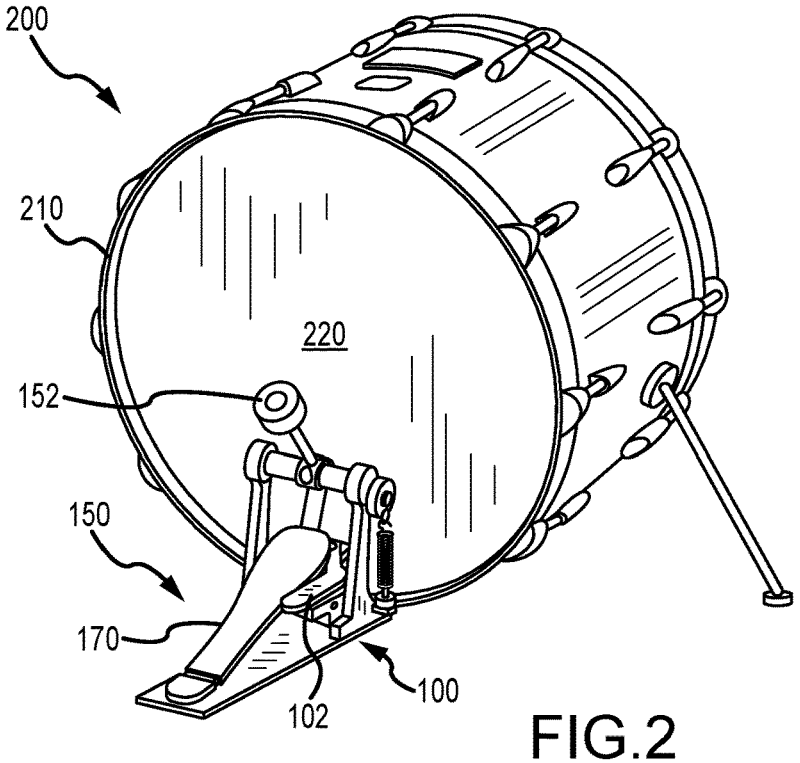
FIG. 2 is a perspective view of a kick drum, showing a pedal assembly.

FIG. 2 is a perspective view of a kick drum or bass drum 200 with an improved kick drum pedal assembly 150 having a lever-actuated hoop clamp mechanism 100. Typically, the drummer plays kick drum 200 by depressing the footboard 170 on pedal assembly 150, for example a formed metal plate, so that the beater mallet 152 strikes the drum head 220. In contrast to prior designs, pedal assembly 150 can be attached to drum 200 using a foot-operated lever actuator 102, providing an easier, more secure coupling of the hoop clamp mechanism 100 to the rim 210 of the kick drum 200.

The lever-actuated hoop clamp mechanism 100 is configured to facilitate installation of the kick drum pedal 150 onto the drum 200 with an easier, more secure mechanical coupling to the hoop 210. The foot-operable lever actuator 102 allows the drummer to secure the kick drum pedal 150 in place onto the hoop 210 of drum 200 with either the left or right foot, without needing to reach down and around the kick drum pedal 150 in order to access the clamp mechanism, and avoiding interference with the snare, toms, cymbals, stands and other components of the drum set. The clamp mechanism 100 also provides an advanced, over-center, load-controlled attachment for a more secure mechanical coupling between the pedal 150 and the drum hoop 210, reducing the need for manual adjustment to maintain the coupling while performing on the drum 200. Hoop clamp 100 can also be provided with quick-release features for easier decoupling, and by eliminating the additional hassles involved with installing and adjusting a conventional kick drum pedal, the improved, lever-actuated clamp mechanism 100 also saves time during setup and installation, and makes disassembly and breakdown quicker and easier.

Figure 3:
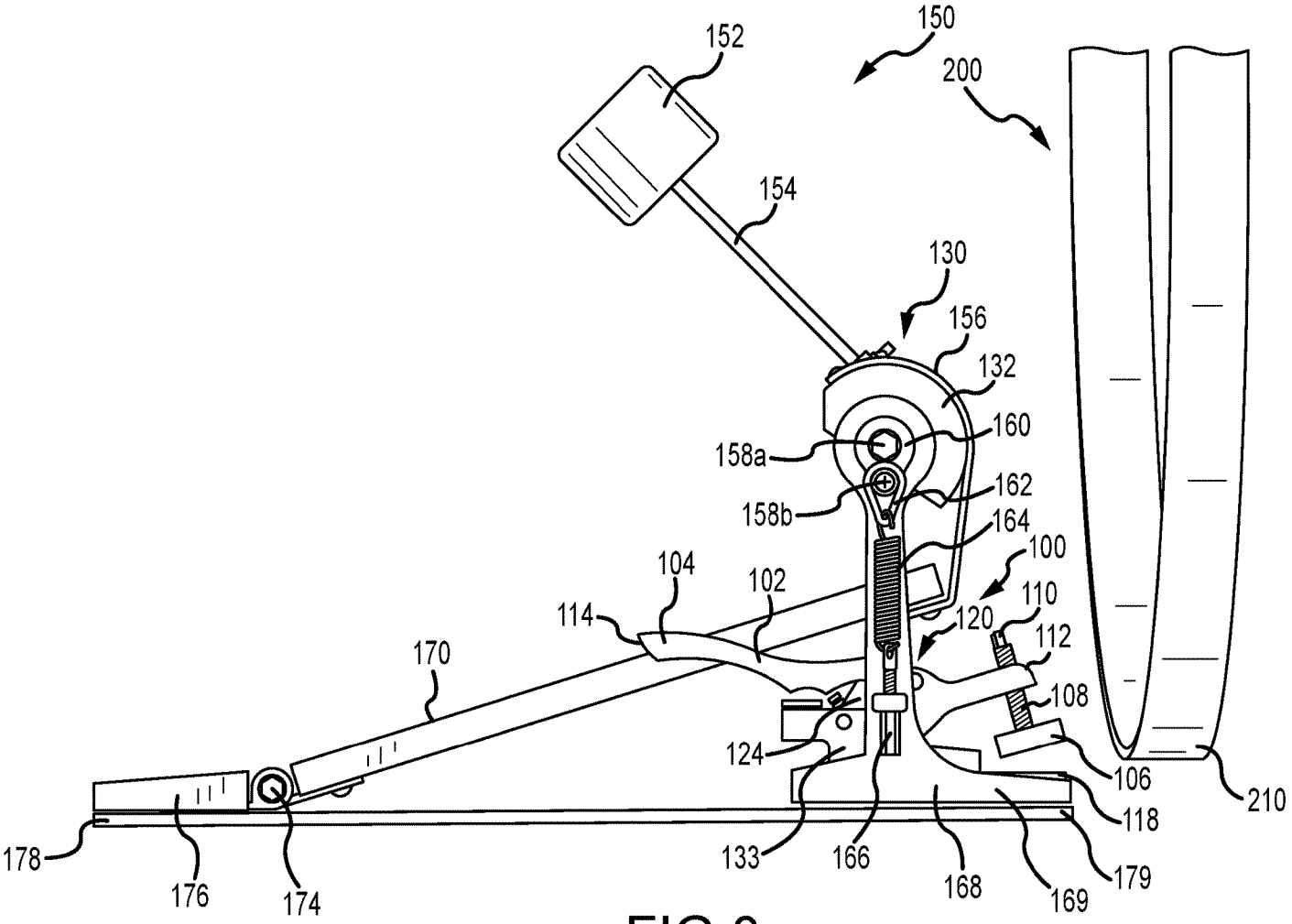
FIG. 3 is a side view of a kick drum pedal assembly, showing a lever-actuated hoop clamp mechanism.

FIG. 3 is a side view of a lever-actuated hoop clamp 100 for a kick drum pedal 150, in accordance with various embodiments of the disclosure. As shown in FIG. 3, the kick drum pedal 150 includes a beater support assembly 130, a footboard 170, a heel plate 176, a base plate 178 extending to a front end 179 proximate drum 200, and a hoop clamp 100 adapted for coupling kick drum pedal 150 to kick drum 200.

The beater support assembly 130 includes a rocker 132 coupled to a beater mallet 152 on a beater shaft 154, and a chain or belt drive 156 with a spring 164 coupled between rocker 132 and the upright rocker support members 168. The rocker support or frame members 168 seat on top of the base plate 178, and support the rocker 132, which in turn supports the beater shaft 154 and mallet 152, in pivotable engagement with the footboard 170. A cam plate 160 is rotationally coupled to the rocker 132, adjacent to one (or both) of the upright supports 168. A spring link 162 connects the spring 164 to the cam plate 160, providing a bias force to position the beater mallet 152. Mechanical fasteners 158*a,b* can be used to secure the spring link 162 to the cam plate 160. A beater spring tension adjustment 166 is attached to the upright support 168 at the bottom end of each spring 164, in order to adjust the play in pedal assembly 150 when striking the drum 200 with the beater mallet 152.

The beater support assembly 130 is connected to an end of the footboard 170 by the chain or belt drive component 156. The other end of the footboard 170 is connected to the heel plate 176 by a hinge 174. The footboard 170 rests at an angle above the base plate 178, in between the heel plate 176 and the beater support assembly 130. The hinge 174 allows a drummer to play the drum 200 with his or her foot by moving the footboard 170 in a downward motion, so that the angle between the footboard 170 and the base plate 178 decreases. As the footboard 170 lowers, it drives the chain or belt drive 156 downward, which in turn rotates the rocker 132 to drive the beater mallet 152, on the end of the shaft 154, towards the drum 200.

As shown in FIG. 3, the hoop clamp mechanism 100 seats on top of the base plate 178, in between the upright frame or support member 168 and the footboard 170; however, it is contemplated that the hoop clamp 100 may be positioned anywhere along the kick drum pedal mechanism 150; e.g., along the front edge toward the drum 200, for attachment to the rim 210. The clamp mechanism 100 can be mechanically fastened to the base plate 178 by screws, bolts, or the like, or it can be welded or molded into the base plate 178, or formed as an integral component of the kick drum pedal 150.

The hoop clamp mechanism 100 includes a lever actuator 102 with a back-end lever arm 104 coupled to a front-end lever arm or caliper 112 at pivot assembly 120. The back-end lever arm 104 can include a foot pad 114 or similar interface for engaging and disengaging the hoop clamp mechanism 100. The front arm 112 is coupled to an upper jaw or engagement pad 106 via a screw or rod 108 with length adjustment key 110, in order to engage the rim 210 of drum 200 between the upper jaw member 106 and the lower jaw or base pad 118. In preferred embodiments, the lever actuator 102 utilizes an over-center action for pivot assembly 120, so that a preselected compressive load is provided on rim 210 between the upper pad component 106 and the lower base pad 118 and is maintained, holding the kick drum pedal 150 in place. The load can be selected by adjusting the length of the screw or rod 108 via a key or similar adjustment 110, depending on the hoop thickness and desired coupling strength.

Figure 4A:
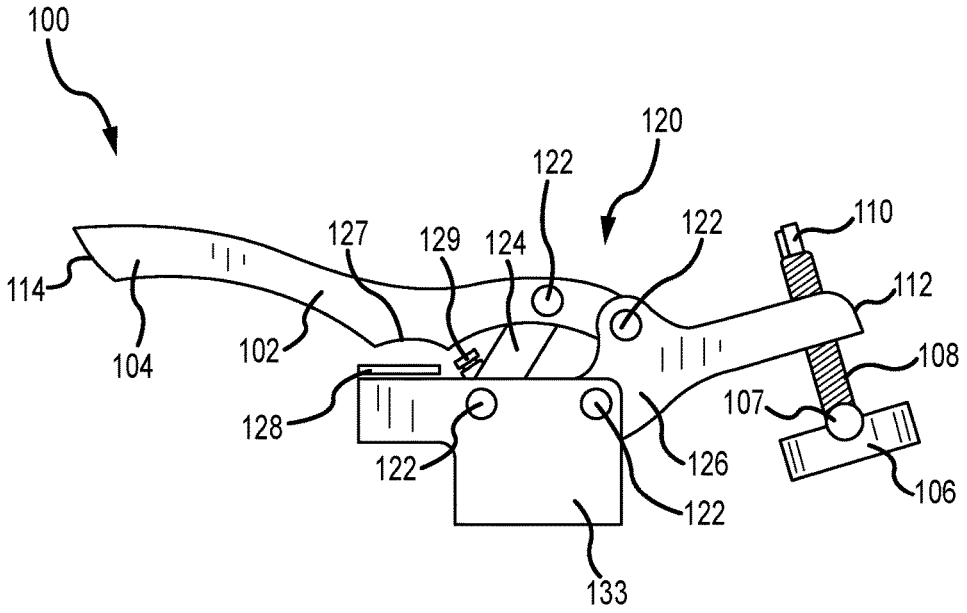
FIG. 4A is a side detail view of a hoop clamp mechanism, disengaged from a drum.
Figure 4B:
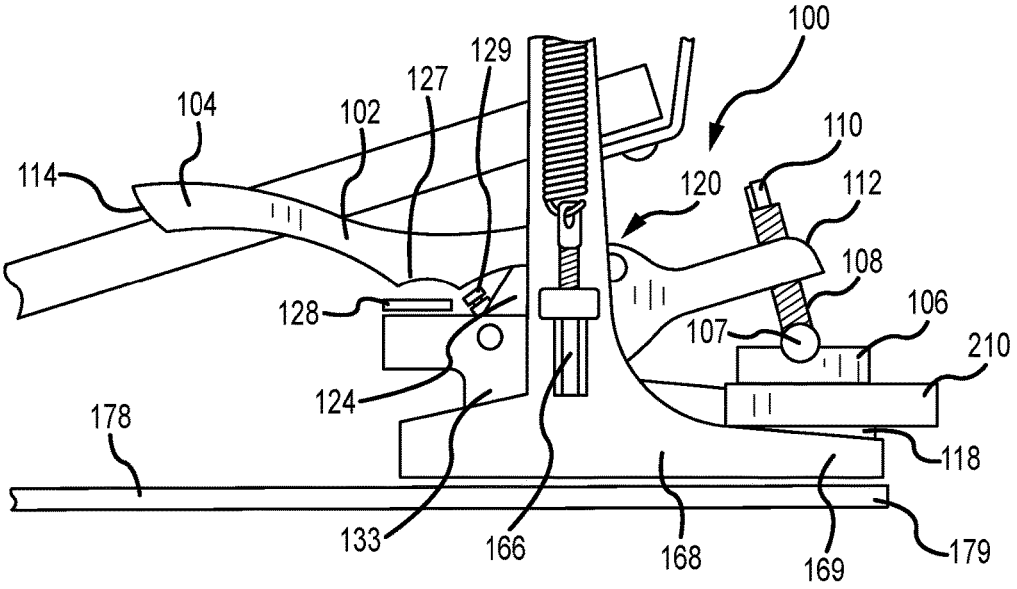
FIG. 4B is a side view of the hoop clamp mechanism of FIG. 4A, engaged with the drum.

FIG. 4A is a side view of a hoop clamp 100 for use with a kick drum pedal, in a disengaged position. FIG. 4B is a side view of the clamp mechanism 100 engaged with the hoop 210 of a kick drum 200.

As shown in FIGS. 4A and 4B, the clamp mechanism 100 is operated by a lever actuator 102 including a front end caliper arm 112 with an adjustable screw, rod or post 108 coupled to a to a pad 106 or similar hoop engagement member, and a back-end lever arm 104 with a foot pad or similar interface 114. The clamp base pad or lower base coupling 118 extends from the front (drum-facing) end of the clamp mechanism 100, along all or a portion of the longitudinal (horizontal) length of the upright frame component 168.

FIG. 4A shows the over-center clamping mechanism 100 with a bi-stable pivot assembly or latch 120. The clamping mechanism 100 has a body 133, a pivot assembly 120 with a plurality of two, three, four or more pivots 122, and one or more engagement arms 124 and 126. In this particular example, engagement arm 124 is pivotably engaged between lever actuator 102 and body 133 at pivots 122, and engagement arm 126 is pivotably engaged between lever actuator 102, front arm 112 and body 133 at additional pivots 122. Clamp 100 is shown in the first bi-stable (disengaged) position, with the upper engagement pad 106 disengaged from the drum hoop.

The lever actuator 102 is operated to drive arms 124 and 126 from the first bi-stable (unlocked) position over center to the second bi-stable (locked) position, engaging clamp 100 with the drum hoop 210 (shown in FIG. 4B). When a force applied to the lever actuator 102 exceeds a threshold force, the clamping mechanism 100 is able to transition from the first bi-stable position over center to the second bi-stable position or from the second bi-stable position over center to the first, depending upon the direction of the applied force. Depending on the embodiment, engagement feature 127 on lever actuator 102 encounters a fixed stop or adjustable set screw 129 to torque pivoting arms 124 and 126, providing mechanical advantage to overcome the force or load threshold necessary to drive the clamping mechanism 100 "over center" from the disengaged position to the engaged position. For example, engagement feature 127 on lever actuator 102 may encounter a complementary engagement surface 128 on body 133, or operate to be positioned adjacent the surface 128 on body 133 as shown.

The stop can be provided in a fixed configuration. Alternatively, an auto-adjust tension set screw or similar manual-adjust mechanism 129 can be provided to change the contact position of engagement 127 with respect to the pivot assembly 120, in order to independently adjust the selected clamping load force, or the engagement threshold, or both. This example is merely illustrative, and other bi-stable and over-center designs are encompassed, in which the number and placement of features 124, 126, 127, 128, and 129 vary accordingly, along with the number and placement of pivots 122. In one example, the clamp 100 may include a spring (not shown) coupled to at least two of the lever actuator 102, the drive arm 124, the drive arm 126, and the body 133. The spring may act to maintain the structural integrity of the clamp when in either the first or second bi-stable positions.

As shown in FIG. 4B, the body 133 of the clamping mechanism 100 can be integrally formed with an upright frame member 168 or base plate 178, for example by casting or machining, or mechanically coupled to the frame member 168 or base plate 178, for example by welding or using screws, bolts, or other mechanical fasteners, with the clamp body 133 abutting one or both of the frame member 168 and base plate 178. In these embodiments, one or more pivots 122 may be provided on or coupled directly to the frame member 168 of the pedal assembly 150, in order to pivotably engage the lever actuator 102 and the front arm 112 of the clamp mechanism 100 with one or more pivot arms 124 and 126 of the pivot assembly 120.

As shown in both FIGS. 4A and 4B, the front end caliper arm 112 is coupled to a pad 106 or similar top jaw engagement component, in order to engage the drum hoop or rim 210 between the top pad 106 and lower jaw or base pad 118 when force is applied to interface 114 on the back arm 104. A pivoting or swivel engagement 107 can be provided between the pad 106 and the screw or post 108, in order align the upper pad 106 with the rim 210 and improve the compressive load transfer between the upper pad 106 and the lower pad 118 and base frame 168 with lower jaw portion 169.

The front end lever arm or caliper 112 is coupled to the top pad or upper jaw engagement member 106 via a rod or screw 108, and adapted for coupling to rim 210 with a suitable compressive load. For example, the clamp pad 106 can be connected to the front end of the caliper 112 by a screw or rod 108 with a length adjustment key 110, so a preset compression load is applied when the lever 102 is actuated to drive the front clamp arm or caliper 112 toward the drum hoop 210, engaging the hoop 210 between the top and bottom pads 106, 118.

The rod or post 108 coupling the front caliper arm 112 to the top pad 106 can include an adjustment key or knob 110. For example, the rod 108 may be formed as a screw or other threaded member with a hex nut or square drum key 110 for adjusting the length of rod 108. Alternatively, a slotted screw mechanism can be provided, or a wing nut or t-shaped key can be provided directly on the top end 110 of rod 108, for tool-less length adjustment. Turning the adjustment key 110 increases or decreases the length of rod 108, which in turns raises or lowers the clamp pad 106 to control the compressive load on the drum hoop 210. However, it is also contemplated that a suitable fixed-length rod 108 may connect the top clamp pad 106 to the front-end caliper arm 112, without an adjustment key mechanism 110, such that the position of the clamp pad 106 is not adjustable relative to the front end caliper arm 112.

In embodiments with a height adjustment 110 for rod 108, the position of the top jaw or clamp pad 106 with respect to the base pad 118 and front end 179 of the base plate 178 may thus be adjusted to accommodate different sized drum hoops 210. The length of the rod 108 between the front end caliper arm 112 and the bottom of the top pad 106 determines the selected compressive loading on the drum hoop 210, when engaged between the top and bottom pads 106, 118, or between the top pad 106 and the lower jaw portion 169 of the frame 168; e.g., if bottom pad 118 is absent. Alternatively, the top caliper arm 112 can also be configured to engage the drum hoop 210 directly against the front 179 of the base plate 178, or the lower pad 118 can be formed as an integral portion of either the front end 179 of the base plate 178 or the lower jaw portion 169 of the frame 168.

The height adjustment can be based on drummer preference for the tightness of the coupling provided by clamp 100 between the drum pedal 150 and the drum hoop 210. For example, a drummer may turn the adjustment 110 to lower the top clamp pad 106 with respect to the lower pad 118 and jaw portion 169, increasing the distance between pad 106 and caliper arm 112 in order to provide a tighter hold on the drum hoop 210, with greater compressive loading. Alternatively, the drummer may turn the adjustment 110 to raise the top clamp pad 106 with respect to the lower pad 118 and lower jaw portion 169 of the frame, decreasing the distance between pad 106 and caliper arm 112 to create a looser hold on the drum hoop 210, with less compressive loading. The clamp pad 106 is able to align parallel to the drum hoop 210 despite any adjustments to the height adjustment 110.

It is contemplated that the top clamp pad 106 may also be attached to the front end caliper arm 112 of the clamp 100 on a swivel 107, so that the pad 106 can pivot back and forth and from right to left for better, more parallel mechanical coupling with the drum hoop 210, preferably without rotational motion in the plane of pad 106 to maintain angular orientation with respect to the drum head. However, the clamp pad 106 may also be fixed to the clamp pad height adjustment or rod 108 without pivoting engagement 107, or with both pivoting and rotational freedom of motion.

One or both of the top pad 106 and the bottom pad 118 may be made of a conforming flexible or compressive material, such as rubber, polymer, nylon, thermoplastic polyurethane (TPU), ethylene vinyl acetate (EVA), or the like. While the figures depict the pads 106, 118 with rectangular shapes, it is contemplated that the pads may be of any shape capable of conforming to a drum hoop, such as, for example, a circular shape, oval shape, or other suitable shape.

The top pad 106 presses against the top of the drum hoop 210 when a force is applied to operate the clamp mechanism 100; e.g., with a downward force applied to the foot pad or similar interface 114 on the back arm 104 of the lever actuator 102. The drum hoop 210 seats between the top pad 106 and the bottom or base pad 118; e.g., where the base frame 168 extends along the length of the base plate 178 toward the front end 179, in order to form a lower jaw portion 169 coupled to bottom pad 118. However, the hoop 210 can also be coupled directly between the top pad or similar component 106 and the lower jaw portion 169 of the frame 168. Alternatively, if the base frame 168 does not extend to the front end 179 of the base plate 178, the drum hoop 210 may seat between the top pad 106 and a bottom pad 118 affixed to the base plate 178, or between the top pad or similar component 106 and the base plate 178.

Figures 4C, 4D, 4E:
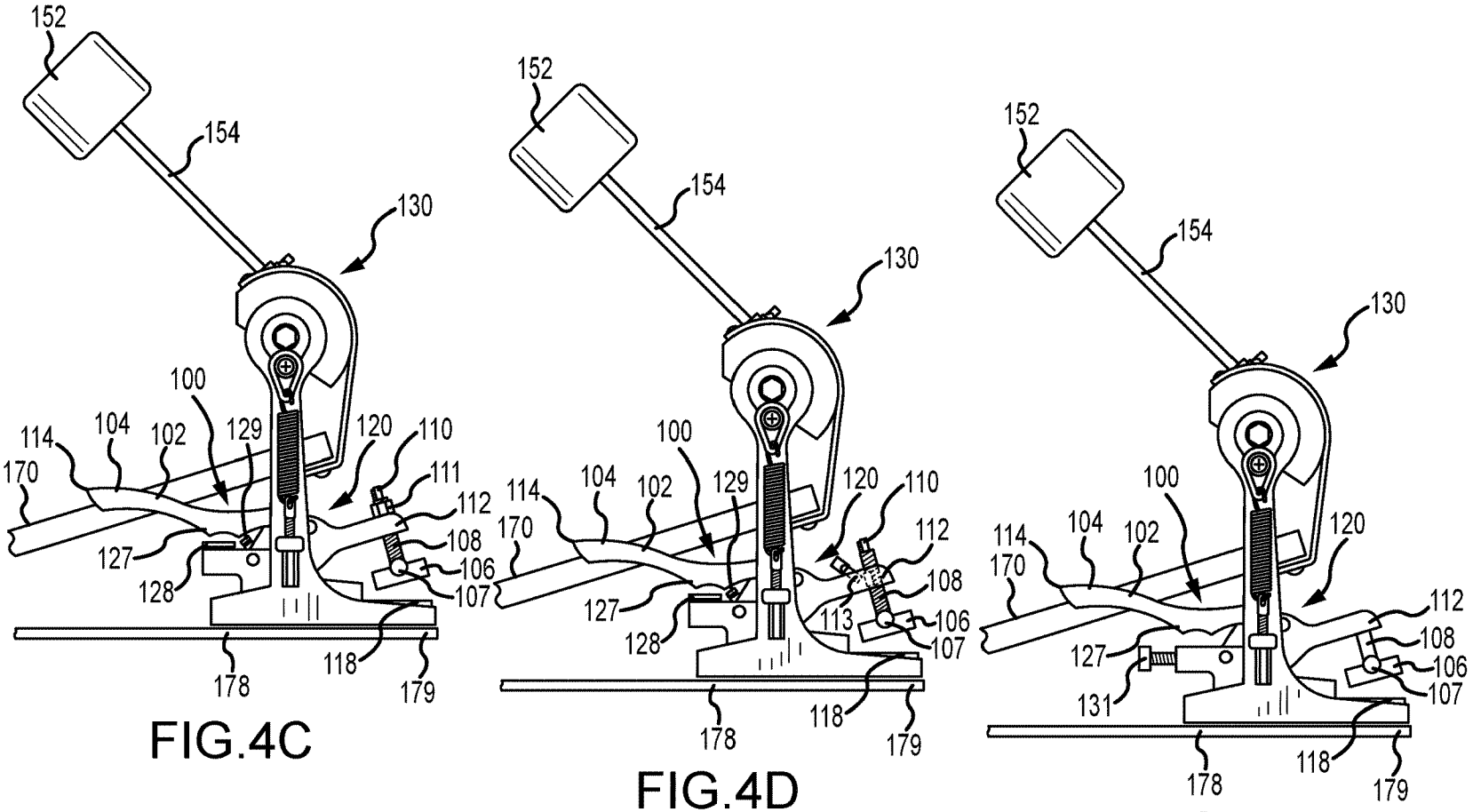
FIG. 4C is a side view of a hoop clamp mechanism with an auto-adjust set screw and lock bolt.
FIG. 4D is a side view of a hoop clamp mechanism with an auto-adjust set screw and T-rod lock mechanism.
FIG. 4E is a side view of a hoop clamp mechanism with a rear adjust screw.

FIG. 4C is a side view of the hoop clamp mechanism 100 in an embodiment with an auto-adjust set screw 129 and lock bolt (or lock nut) 111. As shown in FIG. 4C, the auto-adjust set screw 129 can be manually adjusted to select the clamping load force applied to seat the drum hoop between the clamping mechanism 100 and the base plate 178; e.g., between the clamp engagement pad 106 and a lower jaw or base pad 118 on the front end 179 of the base plate 178. The lock bolt or lock nut 111 can be used in conjunction with the adjustment key 110 to increase or decrease the length of rod 108, and to lock rod 108 in place to position the clamp pad 106 with respect to the front-end lever arm 112, and to control the compressive loading on the drum hoop when seated between the upper pad 106 and the lower pad 118 on the front end 179 of base plate 178.

In some embodiments, an auto-adjust screw 129 can be used to set the clamping force independently of the engagement threshold, and independently of the width of the drum hoop. In other embodiments the adjustment key 110 and lock bolt or lock nut 111 can be used to set the compressive load as a function of the drum hoop width. Alternatively, a similar adjustment mechanism can be used to set the engagement threshold independently of the clamping force, or both the clamping force and the engagement threshold can be adjusted together.

FIG. 4D is a side view of the hoop clamp mechanism 100 with an auto-adjust set screw 129 and T-rod lock mechanism 113. In this embodiment, T-rod lock mechanism 113 is used in place of the lock bolt or lock nut 111, in order to fix the length of rod 108 with respect to the front-end caliper arm 112 and the top clamp pad 106.

FIG. 4E is a side view of the hoop clamp mechanism 100 with a rear adjust screw 131. In this example, adjustment screw 131 is used to adjust one or both of the clamping force and the engagement threshold, either independently of or depending on the drum hoop width. For example, it is also contemplated that a suitable fixed-length rod 108 can be used to connect the top clamp pad 106 to the front-end caliper arm 112, without an adjustment key mechanism 110, lock bolt or nut 111, or T-rod lock mechanism 113, so that the position of the clamp pad 106 is fixed relative to the front end caliper arm 112.

The tension and load adjustment mechanisms in FIGS. 4A-4E are merely representative. In these various embodiments, the clamping load, engagement threshold and disengagement threshold can be independently adjusted, and they may depend on the thickness or width of the drum hoop, or adjusted automatically, independently of the hoop width.

Figure 5:
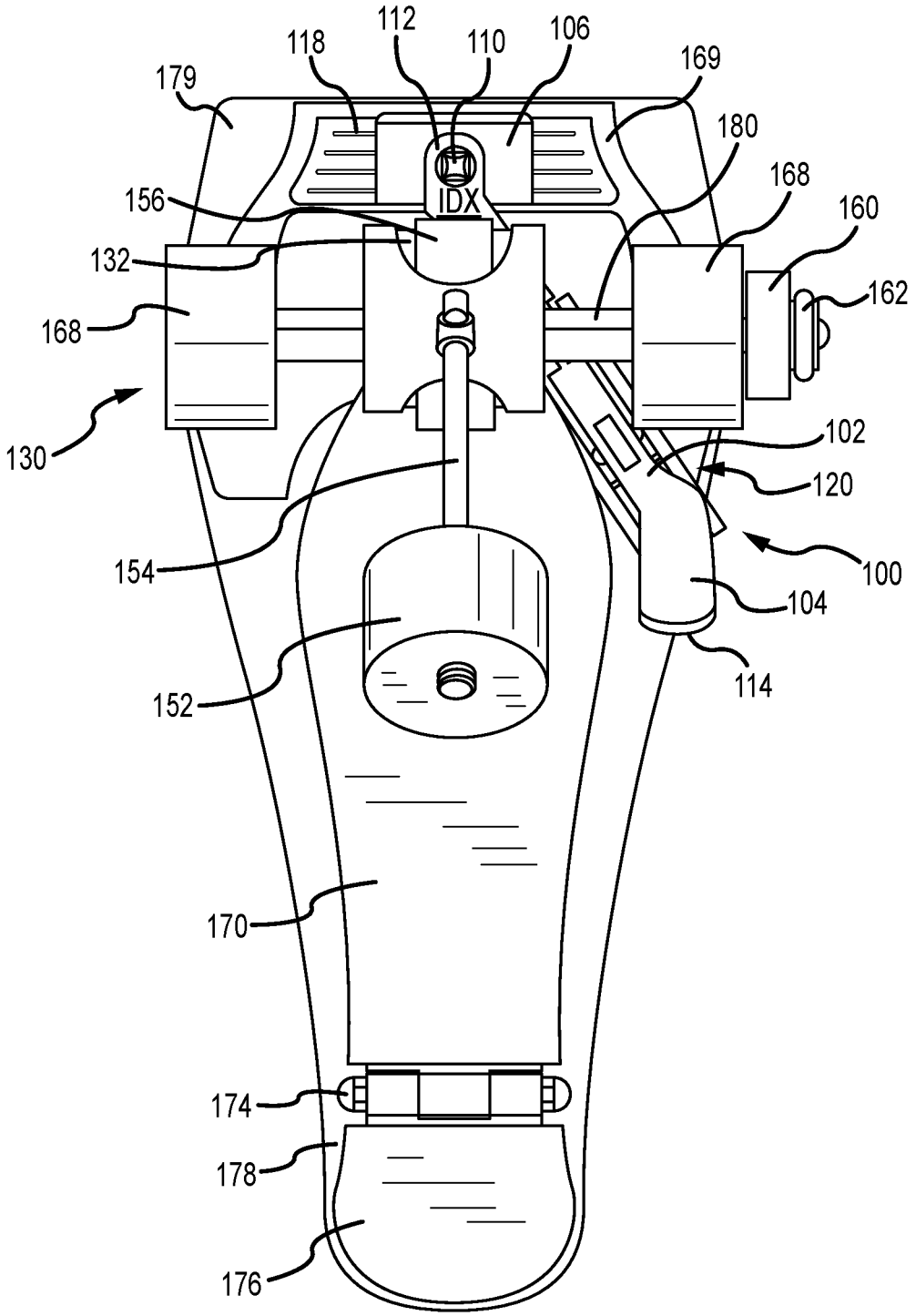
FIG. 5 is a top plan view of a kick drum pedal with a lever-actuated hoop clamp.

FIG. 5 is a top plan view of the kick drum pedal 150 with lever-actuated hoop clamp 100. As shown in FIG. 5, the beater mallet 152 is supported on the rocker 132 by shaft 154. Rocker 132 is rotationally coupled to cam plate 160 by a crossbar or drive shaft 180, supported at each end by the frame 168.

The clamp mechanism 100 has a lever actuator 102 at its back end, readily accessible to the drummer adjacent the footboard 170. The lever actuator 102 includes a front-end caliper arm 112 and a back-end lever arm 104, coupled together at the pivot assembly 120. The back-end lever arm 104 of lever actuator 102 includes a foot pad 114, or similar user interface for application of a force or torque to operate the hoop clamp 100. The foot pad 114 may be a grip surface that allows a drummer to easily push down on the back-end lever arm 104 with his or her foot in a position selected for application of torque to the lever actuator 102, without sliding along the surface of the back-end lever arm 104. For example, the foot pad 114 may be formed of or include a layer of rubber, polymer, or the like, or it may be formed as a number of grooves or other features in the back-end lever arm 104.

The user interface 114 may also be formed with a lip structure, so the drummer can place his or her foot underneath the lever arm 104 to push up on the lever actuator 102, releasing the clamp mechanism 100. The interface end 114 of the lever arm 104 may also be formed as a substantially flat or angled feature. The lever arm 104 may be at a height and angle to conform along the side of the footboard 170 as shown, either at approximately the height of the footboard 170 when positioned to strike the kick drum with pedal assembly 150, or when the footboard 170 is released, or at a suitable height therebetween. The lever arm 104 can also be of various lengths and width, depending on the geometry of the footboard 170 and pedal assembly 150. In various examples, the back-end lever arm 104 has a relatively small width and extends so that lever actuator 102 remains within a footprint of the base plate 178, and does not extend horizontally out past the other components of the pedal assembly 150.

The hoop clamp mechanism 100 can be configured with a pivoting arrangement 120 for lever actuator 102, as described herein, so that a downward force applied to the foot pad 114 acts to clamp the drum hoop between the upper "jaw" or caliper arm 112 with top pad component 106, and a complementary lower pad 118 attached to the lower jaw portion 169 of the base frame 168. Alternatively, the lower pad 118 can be coupled directly to the front end 179 of the base plate 178, or the hoop clamp 100 can operate to couple the hoop directly between either the upper pad 106 or upper caliper arm 112 and the lower jaw component 169, or directly to the base plate 178.

A compressive vice-type loading is applied by clamp mechanism 100, in order to grip the drum hoop with a preselected gripping force. In contrast to screw-operated hoop clamps, the lever-actuated mechanism 100 can maintain the same preselected compressive load for repeated operations of the lever actuator 102, simply by applying a suitable force to the back-end lever arm 104 via the interface 114, without the need to set the loading manually each time a drum is coupled to the pedal assembly 150.

As mentioned, and depending on the embodiment, lever actuator 102 can be provided with an over-center pivot assembly 120, or similar threshold engagement, so that hoop clamp 100 is engaged when a force or torque exceeding the over-center actuation threshold is applied to the back-end lever 102, e.g., by pressing down or up on the foot pad or similar interface 114. In response to a suitable force, the lever mechanism 100 acts to apply a fixed compressive loading or grip force onto the drum hoop, independent of the force or torque applied to the interface 114, as long as it exceeds the actuation threshold. Thus, when resistance is felt on the user interface 114 of the back-end lever arm 104, the hoop clamp 100 begins applying a compressive load to the drum hoop. When the actuation threshold is reached or exceeded, the preselected loading is applied and the back-end lever arm 104 locks into place, with the hoop engaged between the upper jaw or front-end caliper 112 and the front end 179 of the base plate 178.

Further, a load adjustment 110 can be provided to change the preselected force applied to the drum hoop by clamp mechanism 100, depending on hoop size and thickness, user preference, performance conditions, and other factors, as described above. The same preselected loading or "tightness" of the coupling can then be used for coupling the kick pedal assembly 150 each time, either to the same or similar kick drum hoop configurations, or different loading values can be preselected for a range of differently sized hoops and playing conditions. A visual index IDX, an index with a rotational detent, or the like can also be provided adjacent the adjustment mechanism 110, and scaled for different hoop thicknesses, or for different selected loadings, or both. In an alternate embodiment, the loading or tightness can be based on an automated response to drum hoop thickness, such that no manual adjustment is necessary to obtain the same loading or tightness for coupling the kick pedal assembly 150 each time.

Figure 6B:
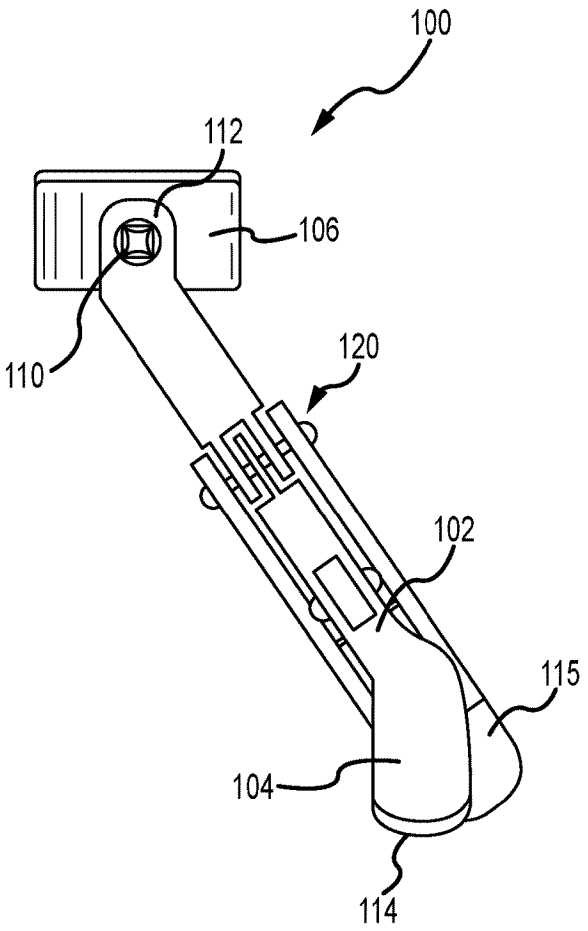
FIG. 6B is a top plan view of a lever-actuated hoop clamp with a release lever.
Figure 6A:
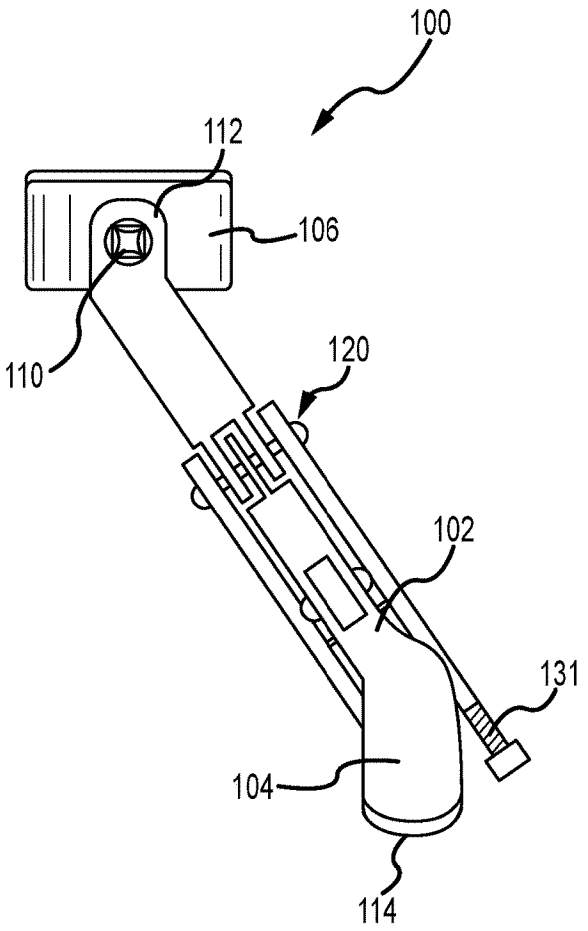
FIG. 6A is a top plan view of a lever-actuated hoop clamp in a self-release configuration.

FIG. 6A is a top plan view of the lever actuator 102 in a self-release configuration. As shown in FIG. 6A, a suitable foot-operable or manually-operated interface 114 can also be adapted to disengage the hoop clamp 100; e.g., by allowing the drummer to pull up on the back-end lever arm 104 with his or her foot or toe, as described above, in order to release the actuator 102 when the upward force or torque exceeds a first, upward-acting, preselected disengagement threshold. Other quick-release mechanisms can also be utilized; e.g., by applying a suitable downward force or torque on interface 114, which exceeds the actuation threshold and reaches a second, downward-acting disengagement threshold, thus releasing the lever actuator 102 and disengaging the hoop clamp 100 from the kick drum.

In some embodiments, the hoop clamp 100 can also include an alternate position for the rear set screw or similar manual load adjustment 131, as shown in FIG. 6A. For example, the lever actuator 102 may include a tension adjustment screw, knob or lever 131 coupled to the pivot assembly 120, e.g., adjacent the back-end lever section 104. The adjustment 131 can be adapted to tighten or loosen the tension in pivot assembly 120, in order to change the actuation threshold or "tightness" of the actuator lever 102, or to adjust compressive loading applied to the drum hoop by the clamp mechanism 100, or both. In additional embodiments, the clamp mechanism 100 contains an actuation threshold or compressing loading adjustment coupled directly to the pivot assembly 120, or to the lower frame of the pedal assembly.

FIG. 6B is a top plan view of the lever actuator 102 with a separate release lever 115. In this configuration, lever actuator 102 is disengaged by applying a force or torque to the release feature 115; e.g., a downward force or torque exceeding a release threshold. As compared to the self-release embodiment of FIG. 6A, a separate release lever 115 can be disposed in a readily accessible location below the interface 114, where it is protected from incidental contact, so that the drummer or other user can release the lever actuator 102 without having to pull up on the lever arm 104.

In one embodiment, the clamp mechanism 100 includes a separate release lever 115 located underneath the user interface 114 on the back-end lever arm 104. While interface 114 is used to engage the lever actuator 102, when a suitable pressure is applied to the release lever 115, it releases the clamp mechanism 100 so the kick drum pedal assembly can be removed from the drum hoop. The interface 114 and release lever 115 can both be easily accessible by foot, allowing the drummer to press down on either lever 114 or 115 without using his or her hands, in order to install and uninstall the kick drum pedal without having to bend over or work around the other drum set components in order to operate the clamping mechanism by hand.

EXAMPLES

This application describes a kick drum pedal mechanism with an improved hoop clamp. In one example or embodiment, the kick drum pedal includes one or more of a base plate, a heel plate, a footboard, a chain or belt drive, a beater shaft, a beater mallet, a spring, and a hoop clamp with a lever. The hoop clamp is configured to facilitate installation of the kick drum pedal on a hoop of a kick drum or bass drum. For example, the lever on the hoop clamp can allow a drummer to secure the kick drum pedal in place on the kick drum hoop without needing to reach around the side or back of the kick drum pedal mechanism, or to avoid other drums and cymbal components in the drum set in order to reach the clamp fastening mechanism. By eliminating the extra hassles involved with installing conventional kick drum pedals, the improved clamp saves time during the installation process.

In another example or embodiment, a kick drum pedal is disclosed that includes a hoop clamp that extends along a length of the pedal's footboard. The hoop clamp includes a fastening mechanism that allows a drummer to apply a vertical force to secure or release the hoop clamp with a kick drum hoop. The fastening mechanism of the hoop clamp extends to a position away from the beater support assembly and closer to the drummer, providing the drummer with easier access. For example, because the fastening mechanism runs parallel to the footboard, a drummer may use his or her foot to apply the vertical force to the fastening mechanism. The drummer may use his or her foot to push down or pull up on the fastening mechanism to tighten or release the engagement of the hoop clamp with the drum hoop. Thus, a drummer can avoid bending down and reaching over and around objects to install and uninstall the kick drum pedal.

In another example or embodiment, a kick drum pedal hoop clamp is disclosed. The hoop clamp secures a kick drum pedal to a kick drum hoop. The hoop clamp includes a lever configured to tighten and loosen the clamp and a clamp pad configured to engage with the kick drum hoop. The lever allows a drummer to apply a vertical force to the hoop clamp to either tighten or loosen the engagement of the clamp pad to the kick drum hoop. For example, a drummer can push down on the lever to tighten the engagement of the clamp pad to the kick drum hoop and secure the kick drum pedal to the kick drum hoop. As another example, a drummer can pull up on the lever to release the engagement and remove the kick drum pedal from the kick drum hoop.

In another example or embodiment, a method for installing a kick drum pedal to a kick drum hoop is disclosed. The method includes aligning the kick drum pedal in front of the base drum, sliding the pedal onto the base drum hoop such that the hoop seats between the clamp and the base plate of the pedal, and pushing down on the hoop clamp lever.

The above specification and examples provide a description of the structure and use of exemplary embodiments of the invention as defined in the claims. Although the features of the invention have been described with a certain degree of particularity, and with reference to one or more individual embodiments, those skilled in the art will understand that various changes can be made to the examples that are disclosed in the various embodiments without departing from the spirit or scope of the invention as claimed. Other examples are also contemplated, of which the above description and accompanying drawings are merely illustrative, and they do not limit the scope of the claims except where expressly recited therein. Other changes in details and structures of the claimed features are also encompassed, and may be made without departing from the basic elements of the invention as defined in the following claims.

What is claimed is:

1. A drum pedal apparatus comprising:

a base;

a footboard pivotably coupled to the base, the footboard operable to drive a mallet to strike a drum; and a clamping mechanism attached to the base adjacent the footboard, the clamping mechanism comprising:

a first lever arm adapted to couple the drum pedal apparatus to a drum hoop of the drum;

a pivot assembly coupled to the first lever arm; and a second lever arm coupled to the first lever arm via the pivot assembly, the second lever arm adapted to operate the clamping mechanism;

wherein the clamping mechanism is adapted to apply a selected clamping force to the drum hoop, responsive to the second lever arm pivoting relative to the first lever arm at the pivot assembly.

2. The drum pedal apparatus of claim 1, further comprising a clamp pad coupled to the first lever arm, the clamp pad adapted to apply the selected clamping force by compressive loading on the drum hoop, between the first lever arm and the base.

3. The drum pedal apparatus of claim 2, further comprising an automated compressive loading adjustment responsive to a thickness of the drum hoop, wherein the selected clamping force is obtained for drum hoops of different thicknesses without further manual adjustment.

4. The drum pedal apparatus of claim 2, further comprising:

a rod or screw coupling the clamp pad to the first lever arm, wherein the selected clamping force is selected by adjusting a length of the rod or screw; and a key or screw head configured for adjusting the length of the rod or screw, wherein the selected clamping force is selected by adjusting the compressing loading on the drum hoop, when the clamping mechanism is engaged.

5. The drum pedal apparatus of claim 4, further comprising an indexed compressive loading adjustment coupled to the rod or screw, the indexed compressive loading adjustment adapted to adjust the clamping force according to a geometry of the drum hoop.

6. The drum pedal apparatus of claim 1, wherein the clamping mechanism comprises a bi-stable over-center clamping mechanism operable to drive the first and second lever arms from a first bi-stable or unlocked position over center to a second bi-stable or locked position engaging the clamping mechanism with the drum hoop, the clamping mechanism adapted to apply the selected clamping force to the drum hoop responsive to a force acting on the second lever arm, wherein the force acting on the second lever arm exceeds an engagement threshold of the bi-stable over-center mechanism.

7. The drum pedal apparatus of claim 6, wherein the second lever arm is configured to conform to a shape of the footboard along a side thereof and further comprising a foot-operated interface disposed on the second lever arm, wherein the clamping mechanism is engaged with the drum hoop responsive to a downward force on the foot-operated interface, the downward force exceeding the engagement threshold in a direction toward the base of the drum pedal apparatus.

8. The drum pedal apparatus of claim 7, further comprising:

a body of the clamping mechanism pivotably engaged with the first lever arm and the second lever arm to define the pivot assembly therebetween; and an upright support configured to support the mallet in pivotable engagement with the footboard via a rocker;

wherein the body of the clamping mechanism is integrally formed with the upright support or coupled to the base adjacent to and in abutment with the upright support.

9. The drum pedal apparatus of claim 7, wherein the foot-operated interface is adapted for disengaging the clamping mechanism from the drum hoop responsive to a force on the second lever arm, wherein the force exceeds a disengagement threshold of the bi-stable over-center mechanism, the force acting in a downward direction toward the base of the drum pedal apparatus or in an upward direction away from the base of the drum pedal apparatus.

10. The drum pedal apparatus of claim 7, further comprising a release lever coupled to the pivot assembly adjacent to the second lever arm, the release lever adapted to release the first lever arm from the drum hoop responsive to a force applied to the release lever.

11. A method of operating a drum pedal, the method comprising:

positioning the drum pedal with respect to a drum hoop, wherein the drum pedal comprises a base plate and a hoop clamp mechanism attached to the base plate adjacent a footboard pivotably coupled to the base plate, the footboard operable to drive a mallet to strike a drum, wherein the hoop clamp mechanism comprises a first lever arm adapted to couple the drum pedal to the drum hoop, a pivot assembly coupled to the first lever arm, and a second lever arm coupled to the first lever arm via the pivot assembly, the second lever arm comprising a lever actuator and adapted to operate the clamping mechanism; and applying a force to the lever actuator coupled to the hoop clamp mechanism adjacent the footboard, such that the drum hoop seats between the hoop clamp mechanism and the base plate of the drum pedal, responsive to the applied force being greater than an engagement threshold of the hoop clamp mechanism;

wherein the hoop clamp mechanism applies a selected clamping force to seat the drum hoop responsive to the second lever arm pivoting relative to the first lever arm at the pivot assembly, wherein the selected clamping force is independent of the applied force being greater than the engagement threshold.

12. The method of claim 11, further comprising applying the force to the lever actuator with a foot, wherein the lever actuator is contoured along a side of the footboard to provide operational clearance therewith.

13. The method of claim 12, further comprising applying a second force to the lever actuator with the foot, wherein the hoop clamp mechanism disengages the drum hoop responsive to the second force being greater than a disengagement threshold of the hoop clamp mechanism.

14. The method of claim 11, further comprising operating the footboard to drive the mallet, wherein the mallet is supported on an upright frame member via a rocker in pivotable engagement with the footboard, and wherein the hoop clamp mechanism comprises a plurality of pivot members coupling the lever actuator to the hoop clamp mechanism at a body portion thereof, the body portion being integrally formed with the upright frame member or mechanically coupled to the upright frame member in abutment therewith.

15. The method of claim 11, further comprising adjusting one or both of the engagement threshold of the hoop clamp mechanism and the selected force applied to seat the drum hoop, wherein the hoop clamp mechanism comprises a bi-stable over-center clamp mechanism operable to drive the first and second lever arms from a first bi-stable or unlocked position over center to a second bi-stable or locked position engaging the hoop clamp mechanism with the drum hoop; and wherein the engagement threshold and the selected force applied to seat the drum hoop are independent; or wherein the selected force applied to seat the drum hoop is independent of a thickness of the drum hoop.

16. A drum pedal clamp apparatus comprising:

an over-center clamp mechanism coupled to a drum pedal base;

a clamp pad coupled to the over-center clamp mechanism at a front end of the drum pedal base, the clamp pad configured to engage a drum hoop with a selected clamping force; and a clamp lever actuator coupled to the over-center clamp mechanism at a rear end of the drum pedal base, the clamp lever actuator configured to selectively engage the clamp pad with the drum hoop in response to an applied force greater than an engagement threshold of the over-center clamp mechanism;

wherein the over-center clamp mechanism comprises a first lever arm adapted to couple the drum pedal to the drum hoop, a pivot assembly coupled to the first lever arm, and a second lever arm coupled to the first lever arm via the pivot assembly, the second lever arm comprising the clamp lever actuator and adapted to operate the clamping mechanism to drive the first and second lever arms from a first bi-stable or unlocked position over center to a second bi-stable or locked position engaging the clamp pad of the over-center clamp mechanism with the drum hoop; and wherein the selected clamping force is independent of the applied force, when the applied force is greater than the engagement threshold.

17. The drum pedal clamp apparatus of claim 16, further comprising a foot-operated interface disposed on the clamp lever, wherein the foot-operated interface is adapted to receive the applied force acting on the clamp lever actuator such that the clamp pad engages the drum hoop with the selected clamping force responsive to the applied force being greater than the engagement threshold in a downward direction, toward the drum pedal base.

18. The drum pedal clamp apparatus of claim 17, wherein the clamp lever is disposed adjacent to the footboard and contoured along a side of the footboard to provide operational clearance therewith.

19. The drum pedal clamp apparatus of claim 17, wherein the foot-operated interface is further adapted to receive a second applied force acting on the clamp lever actuator such that the clamp pad disengages the drum hoop from the selected clamping force responsive to the second applied force being greater than a disengagement threshold of the over-center clamp mechanism in an upward direction, away from the drum pedal base, or in a downward direction, toward the drum pedal base.

20. The drum pedal clamp apparatus of claim 16, further comprising an upright frame member adapted to support a mallet on a rocker in pivotable engagement with a footboard, wherein a body portion of the over-center clamp mechanism is integrally formed with the upright frame member or mechanically coupled to the upright frame member in abutment therewith.

* * * * *